US007024701B2

(12) United States Patent
Marty et al.

(10) Patent No.: US 7,024,701 B2
(45) **Date of Patent: *Apr. 11, 2006**

(54) SYSTEMS AND METHODS FOR TRANSFORMABLE SLEEVES

(75) Inventors: Justin Douglas Marty, Salt Lake City, UT (US); Joseph Edward Marty, North Salt Lake, UT (US); Joshua Craig Pace, Salt Lake City, UT (US)

(73) Assignee: Z Gear, Inc., Salt Lake City, UT (US)

( * ) Notice: Subject to any disclaimer, the term of this patent is extended or adjusted under 35 U.S.C. 154(b) by 155 days.

This patent is subject to a terminal disclaimer.

(21) Appl. No.: 10/665,320

(22) Filed: Sep. 20, 2003

(65) Prior Publication Data

US 2004/0128730 A1 Jul. 8, 2004

Related U.S. Application Data

(63) Continuation-in-part of application No. 10/638,990, filed on Aug. 11, 2003, which is a continuation-in-part of application No. 10/251,177, filed on Sep. 20, 2002, now Pat. No. 6,742,225.

(51) Int. Cl.
*A41D 3/02* (2006.01)

(52) U.S. Cl. ..... 2/96

(58) Field of Classification Search ..... 2/93, 2/94, 227, 79, 102, 108, 69, 69.5, DIG. 1, 2/84, 86, 114, 115, 2.17, 243.1, 71, 72, DIG. 2, 2/96; 24/382, 429, 430, 431
See application file for complete search history.

(56) References Cited

U.S. PATENT DOCUMENTS

| | | | | |
|---|---|---|---|---|
| 361,250 | A | 4/1887 | Wright | |
| 2,136,879 | A | 11/1938 | Haber et al. | 2/270 |
| 2,178,885 | A | 11/1939 | Buff et al. | 24/205 |
| 2,274,510 | A | 2/1942 | Wohl et al. | 2/270 |
| 2,483,057 | A | 9/1949 | Leering | 24/205 |
| 2,622,248 | A | 12/1952 | Schaye | 2/80 |
| 2,744,253 | A * | 5/1956 | Freedman | 2/80 |
| 2,856,609 | A | 10/1958 | Persico et al. | 2/269 |
| 2,889,605 | A | 6/1959 | Morin | 24/205 |
| 3,170,167 | A | 2/1965 | Isaacs | 2/269 |
| 3,214,771 | A | 11/1965 | Treiber | 2/270 |
| 3,219,084 | A | 11/1965 | Ausnit et al. | 150/3 |
| 3,328,809 | A | 7/1967 | Payne et al. | 2/269 |
| 3,448,463 | A | 6/1969 | Milone | 2/234 |
| 3,726,329 | A | 4/1973 | Dean | 150/28 R |
| 3,771,169 | A * | 11/1973 | Edmund | 2/2.17 |
| 4,112,556 | A | 9/1978 | Flaum et al. | 24/205.1 R |
| 4,149,275 | A | 4/1979 | Sanchez | 2/269 |
| 4,158,892 | A * | 6/1979 | Gonzales | 2/69.5 |

(Continued)

*Primary Examiner*—Tejash Patel
(74) *Attorney, Agent, or Firm*—Julie H. Gheem; Kirton & McConkie

(57) ABSTRACT

Methods and systems for transforming a volume of material into sleeves by means of a transforming fastener. The transforming fastener has multiple tracks, each track having a pair of matable rows. A slider coupled to the rows transforms the volume of material into sleeves when the slider moves along the rows. The slider accomplishes this transformation by fastening one of the pair of rows while simultaneously unfastening another of the pair of rows.

57 Claims, 16 Drawing Sheets

U.S. PATENT DOCUMENTS 4,200,938 A 5/1980 LeTourneau ..... 2/269
4,485,534 A 12/1984 Pilie et al. ..... 24/384
4,492,006 A 1/1985 Ishii ..... 24/382
4,543,670 A 10/1985 Ehring ..... 2/85
4,602,389 A 7/1986 Brown ..... 2/243 R
4,608,715 A * 9/1986 Miller et al. ..... 2/1
4,631,753 A 12/1986 Ehring ..... 2/85
4,757,577 A 7/1988 Freeman ..... 24/382
4,896,379 A 1/1990 Kape ..... 2/269
4,985,936 A 1/1991 Jones ..... 2/269
5,031,944 A 7/1991 Keyaki ..... 292/307 R
5,033,127 A 7/1991 Schmeltz ..... 2/269
5,044,015 A 9/1991 Howard ..... 2/269
5,072,454 A 12/1991 Trahan ..... 2/70
5,088,128 A 2/1992 Kape ..... 2/269
5,153,944 A 10/1992 Teel ..... 2/243 R
5,170,505 A 12/1992 Rohrer ..... 2/69
5,208,920 A 5/1993 Schaefer et al. ..... 2/269
5,299,323 A 4/1994 Schaefer et al. ..... 2/93
5,490,294 A 2/1996 Kramer ..... 5/413
5,535,453 A 7/1996 Howard ..... 2/269
5,539,932 A 7/1996 Howard ..... 2/269
5,575,010 A 11/1996 Chung ..... 2/227
5,608,915 A 3/1997 Libit ..... 2/228
5,697,130 A 12/1997 Smith ..... 24/383
5,774,892 A 7/1998 Tisdale et al. ..... 2/69
5,787,511 A 8/1998 Garside ..... 2/269
5,794,265 A 8/1998 Reich ..... 2/125
5,815,837 A 10/1998 Christman et al. ..... 2/158
5,894,600 A 4/1999 Chenefront ..... 2/69
5,953,758 A 9/1999 Foster ..... 2/268
6,047,404 A 4/2000 Blanks, I ..... 2/69
6,058,578 A 5/2000 Lan ..... 24/429
6,076,189 A 6/2000 Christman et al. ..... 2/158
6,223,349 B1 5/2001 Roiser ..... 2/2.17
6,253,381 B1 7/2001 Kelley ..... 2/125
6,317,894 B1 11/2001 Blechman ..... 2/269
6,349,413 B1 2/2002 Rose et al. ..... 2/126
6,415,482 B1 7/2002 Pontaoe ..... 24/429
6,742,225 B1 * 6/2004 Marty et al. ..... 24/382
2004/0055118 A1 3/2004 Marty et al. ..... 24/382
2004/0128731 A1 7/2004 Marty et al. ..... 2/69
2005/0034206 A1 2/2005 Marty et al. ..... 2/69

* cited by examiner

SYSTEMS AND METHODS FOR TRANSFORMABLE SLEEVES

RELATED APPLICATIONS

This application is a Continuation-in-part of U.S. patent application Ser. No. 10/251,177, filed Sep. 20, 2002 now U.S. Pat. No. 6,742,225, titled CONNECT-RELEASE ZIPPING SYSTEM, and which is continuation-in-part of U.S. patent application Ser. No. 10/638,990, filed Aug. 11, 2003, titled MULTI-TRACK FASTENING SYSTEM.

BACKGROUND

1. Field of the Invention

The present invention relates generally to methods and systems for transforming, via a fastening mechanism, a volume or compartment of material into varied shapes or configurations. More particularly, the present invention relates to a transformable volume of material that can be selectively divided by a slider that connects two sides of material while simultaneously disconnecting two other sides of material.

2. Background Information

Many existing systems that provide for alternative configurations of volumes of material involve the use of fasteners. One popular type of fastener often used with transformable volumes is a zipper. A typical zipper includes a track or chain having two rows of teeth that interlock with each other. A zipper slider is located on the track so that a user can pull on a pull tab on the zipper slider in order to move the slider up and down the track, thereby causing the zipper to zip open and closed as desired. Some zippers have a stop at one or both ends of the zipper to stop the zipper slider from moving off of the track. Some zippers are designed so that the zipper slider is never removed from the track; other zippers are designed to allow the zipper slider to be removed from one row of the track, thereby allowing the material attached to one row of teeth to be further separated from the material attached to the other row of teeth.

One existing system that provides for alternative volume configurations uses multiple rows of zipper teeth. In particular, this system includes three adjacent rows of zipper teeth, the central row of which has two opposing zipper sliders each located at opposite ends of the row. The user may thus choose to attach one of the adjacent rows to one of the zipper sliders so that the central row and the adjacent row can be zipped up to form a first zipper track. Alternatively, the user may choose to attach the other adjacent row of teeth via the opposing zipper slider so that this adjacent row and the central row can be zipped up to form a second zipper track. This multi-zipper system is used to vary the size or volume of a laundry bag, for example.

Another volume modifying system involves two parallel zippers that lie on top of each other. The user can choose to use either of the zippers to zip up an article of clothing in which the zippers are incorporated. For example, this system, when incorporated into a pair of pants, allows a person to choose to zip up either the first zipper or the second zipper, thereby effectively creating two alternative waist sizes of pants within a single pair of pants. This particular volume modifying system can thus be useful in accommodating weight gain or loss by the person who wears the clothing.

Yet another volume modifying system has an exchange portal through which the ends of a pair of zipper teeth are inserted and through which each row of teeth are thereby exchanged and mated with another pair of zipper teeth. This system requires an elongated extension at the end of the row of zipper teeth that the user must manually align and insert into a small slot in the exchange portal. This volume transforming system allows an occupant inside a hazardous chemical jumpsuit to attach the jumpsuit to zipper teeth on the side of a tent without exposing the occupant or tent to the outside environment.

SUMMARY AND OBJECTS OF THE INVENTION

The present invention basically comprises methods and systems for transforming a volume of material into compartments comprising sleeves by means of a transforming fastener. The transforming fastener has multiple tracks, and each track has a pair of matable rows. A slider coupled to the rows transforms the volume of material into compartments comprising sleeves when the slider moves along the rows. The slider accomplishes this transformation by, when sliding along the rows, fastening together one of the pair of rows while unfastening another of the pair of rows to cause the rows to preferably interchange with each other. In some embodiments of the present invention, this transformation takes place without substantially exposing the interior of the volume to the environment exterior to the volume of material.

Some embodiments of the present invention include a stabilizing system for steadying the transforming fastener while the user propels the slider along the rows. Some embodiments include flaps for keeping the volume of material close in towards the user's torso. The volume of material may also have various standard zippers placed therein to allow one or more of the user's arms and hands extend from the volume of material.

Accordingly, it is an object of some embodiments of the present invention to provide a volume of material that a user may selectively compartmentalize into volumes suitable for use as sleeves.

Another object of some embodiments of the present invention is to provide a compartmentalizing jacket that is transformable by a slider that connects two sides of material while simultaneously disconnecting two other sides of material.

Another object of some embodiments of the present invention is to provide an easy-to-use multi-fastener cape that can alternate between a sleeveless cape and a sleeved cape.

Yet another object of some embodiments of the present invention is to provide a jacket made of a volume of material or fabric and that can transform into alternative configurations, both of which have the same quantum of volume, the transformation taking place without exposing any contents inside the suit to the exterior environment.

A further object of some embodiments of the present invention is to provide a simple multi-zippered system that transforms a cape enclosing an occupant's torso and arms into a sleeved jacket without requiring the occupant's arms to exit the bag.

BRIEF DESCRIPTION OF THE DRAWINGS

The foregoing and other objects and features of the present invention will become more fully apparent from the accompanying drawings when considered in conjunction with the following description and appended claims. Other objects will likewise become apparent from the practice of the invention as set forth hereafter. Although the drawings depict only typical embodiments of the invention and are thus not to be deemed limiting of the invention's scope, the accompanying drawings help explain the invention in added detail.

DETAILED DESCRIPTION OF EMBODIMENTS OF THE PRESENT INVENTION

The following detailed description, in conjunction with the accompanying drawings (hereby expressly incorporated as part of this detailed description), sets forth specific numbers, materials, and configurations in order to provide a thorough understanding of the present invention. The following detailed description, in conjunction with the drawings, will enable one skilled in the relevant art to make and use the present invention.

One purpose of this detailed description being to describe the invention so as to enable one skilled in the art to make and use the present invention, the following description sets forth various specific examples, also referred to as "embodiments," of the present invention. While the invention is described in conjunction with specific embodiments, it will be understood, because the embodiments are set forth for explanatory purposes only, that this description is not intended to limit the invention to these particular embodiments. Indeed, it is emphasized that the present invention can be embodied or performed in a variety of ways. The drawings and detailed description are merely representative of particular embodiments of the present invention.

Reference will now be made in detail to several embodiments of the invention. The various embodiments will be described in conjunction with the accompanying drawings wherein like elements are generally designated by like alphanumeric characters throughout.

Figure 1A:
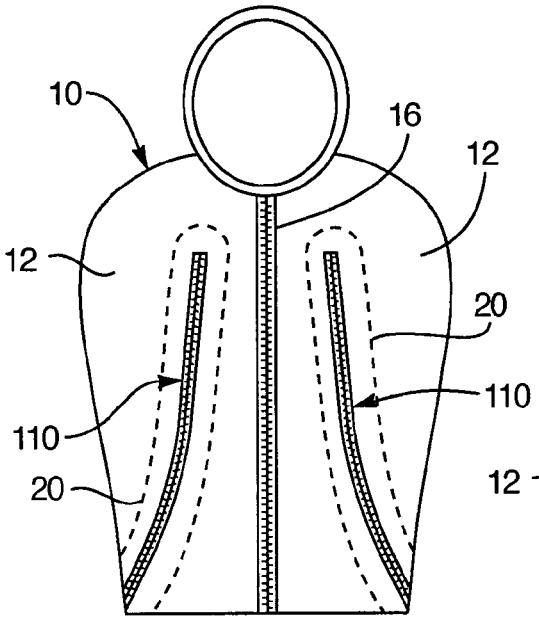
FIGS. 1A and 1B are plan views showing some embodiments of the present invention.
Figure 1B:
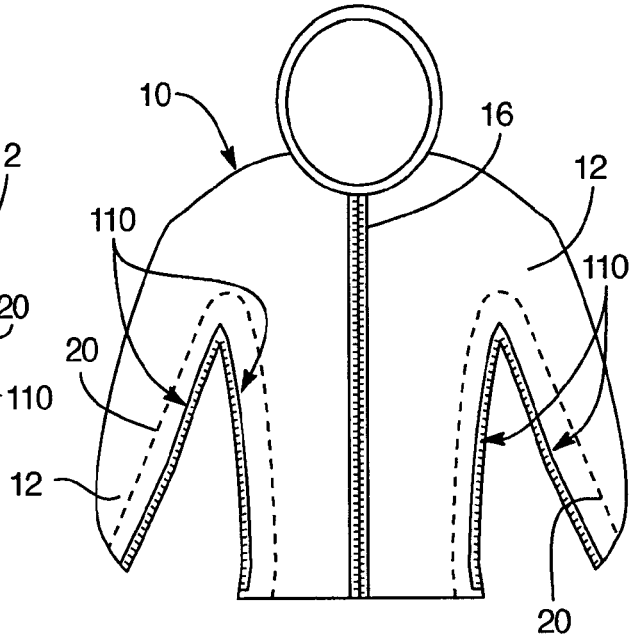

FIGS. 1A and 1B show a volume of material 10 and transforming fasteners 110 incorporated into the volume of material 10 in accordance with some embodiments of the present invention. The volume of material 10 comprises material or fabric and is designed to be worn by a user. The volume of material 10 comprises material capable of serving as sleeves 12 or, in other words, as compartments, preferably substantially cylindrically shaped, suitable for encasing the user's arms and/or hands. Some embodiments may further include a standard zipper 16 coupled to the volume of material 10 to allow a user to thereby enter and exit the volume of material 10. Stretchable or elasticized fabric 20 may also be placed between one or more of the transforming fasteners 110 and the volume of material 10 in order to help the slider (described further herein) of the transforming fastener 110 slide smoothly along the tracks (also described further herein).

The transforming fasteners 110 each comprise multiple tracks, each track comprising a pair of matable rows that preferably comprise zipper teeth. Each transforming fastener 110 also comprises a slider slidably coupled to the rows for transforming the volume of material 10 between alternative configurations or formations. The slider accomplishes this transformation by fastening one of the pair of rows together while simultaneously unfastening another of the pair of rows, thereby causing the rows to preferably interchange. Examples of transforming fasteners, tracks, rows, and sliders will be described further herein.

The rows, whether or not they comprise zipper teeth, can be made of any type of material, including metal, plastic, and nylon, and can have any variety of shapes, weights, and lengths. In addition, the transforming fastener 110 can have any number of rows or tracks, and the rows need not be physically completely separate from each other—for example, two rows could comprise both ends of a long continuous row that has been bent in the middle so as to form the shape of a "U."

In some embodiments of the present invention, the slider of the transforming fastener 110 is irremovably coupled to the tracks in that the slider is not designed to be completely removed by the user from any of the rows, unlike with some standard zippers found on jackets, for example (wherein a standard zipper slider is detachable from one row of zipper teeth at the bottom of the jacket in order to allow a person wearing the jacket to remove the jacket or otherwise wear it open). However, some embodiments of the present invention contemplate a slider that can indeed be removed from one or more of the rows, some of the rows of which might include a standard zipper pin at one end (well known in the art), the zipper pin being designed to be manually insertable into a standard zipper box (also well known in the art) that is fixed to one end of a row.

Each of the transforming fasteners 110 divide or compartmentalize the volume of material 10 so as to transform it from a first undivided formation or configuration to a second divided formation or configuration. For example, FIG. 1A shows the volume of material 10 in the formation of a cape, or, in other words, a compartment suitable for enclosing a user's torso and arms. FIG. 1A shows a first formation in which the material comprising the sleeves 12 are part of the sides of the cape so that the interior volume enclosed by the volume of material 10 is substantially undivided. In contrast, FIG. 1B shows the volume of material 10 in a second formation comprising a cape in which the user's arms are separately enclosed by the sleeves 12. In this formation, the sleeves 12 are compartments that are substantially divided from the rest of the volume of material 10. In light of this example of the transformation between the configuration in FIG. 1A and the configuration in FIG. 1B, it will be noted that in the first formation, as defined herein, the relevant volume (the volume near the user's arms) is substantially undivided; in the second formation, the relevant volume has been divided. The transforming fasteners 110 can cause this transformation between the first and second formations (and vice versa), as will be explained further herein.

Figure 2:
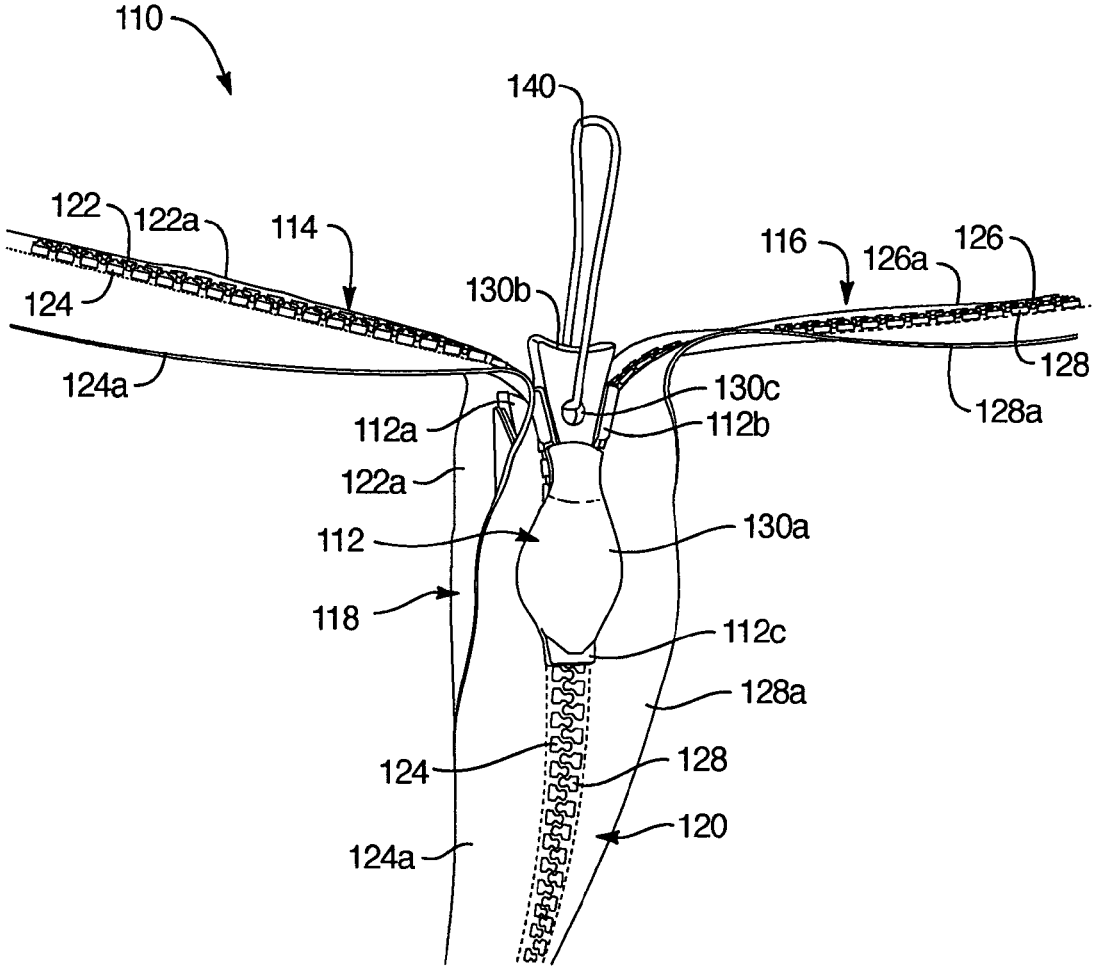
FIG. 2 is a perspective view showing one embodiment of a transforming fastener of the present invention.
Figure 3:
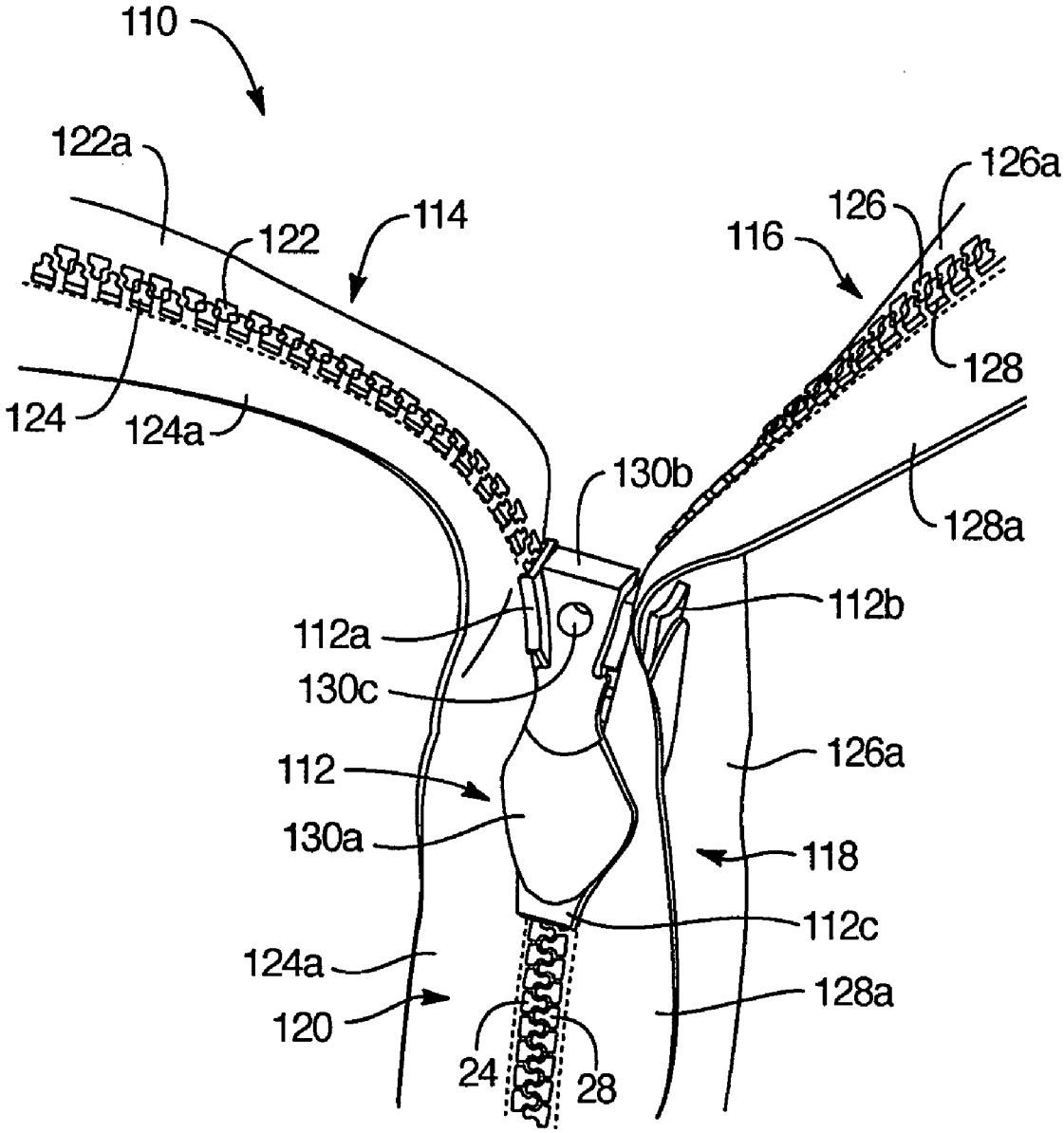
FIG. 3 is another perspective view of an embodiment of a transforming fastener.

FIGS. 2 and 3 show perspective views of one embodiment of the transforming fastener 110. This transforming fastener 110 basically comprises a first track 114, a second track 116, and a central slider or interchange 112. First track 114 comprises two rows 122 and 124, here shown as zipper teeth, that are matable with each other. Second track 116 also comprises two matable rows 126 and 128, here also shown as zipper teeth. The tracks 114 and 116 are coupled to the volume of material 10 via strips of tape or other connector material (that is, anything serving to directly connect the rows to the volume of material 10) 122*a*, 124*a*, 126*a*, and 128*a* extending from each side of the rows. Preferably, the rows 122, 124, 126, and 128 each comprise a row of teeth that interlock with each other as shown in FIGS. 2 and 3.

Figure 4:
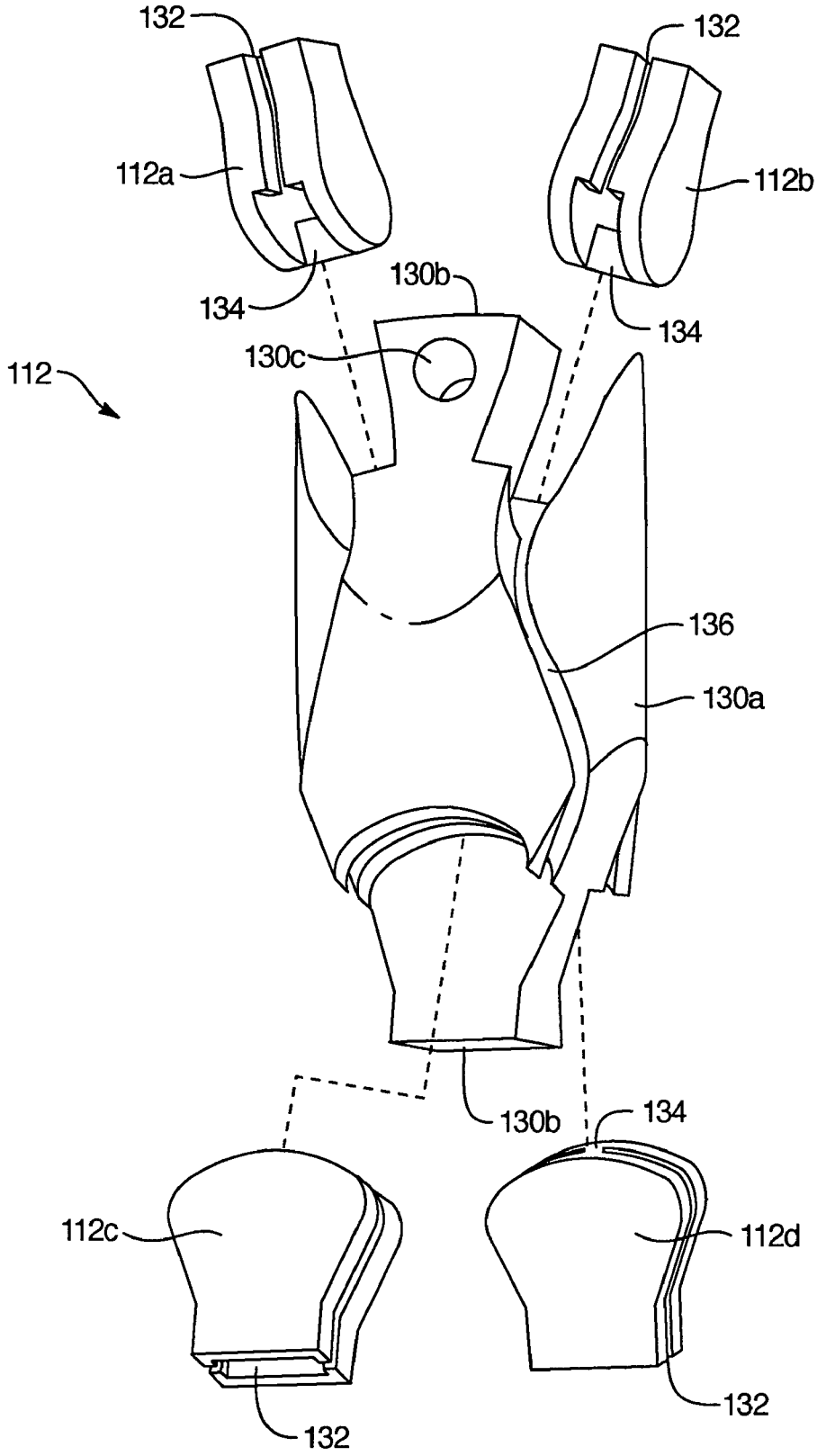
FIG. 4 is an exploded perspective view of one embodiment of a central slider of a transforming fastener of the present invention.

Central slider 112 is one embodiment of a slider comprising various parts, including slider parts 112*a* through 112*d* (an example of which can be seen best in FIG. 4). Central slider 112 closes or mates some of the rows together when it is slid along the tracks. Central slider 112 can also open or disengage some of the rows from each other when the central slider 112 is slid along the tracks.

When this central slider 112 is propelled along the tracks, the rows of the tracks interchange. For example, as can be seen in FIGS. 2 and 3, the rows 122, 124, 126, and 128 of the two tracks 114 and 116 interchange so as to re-form into tracks 118 and 120. At the top of FIGS. 2 and 3, it can be seen that track 114 comprises the mated rows 122 and 124, and track 116 comprises the mated rows 126 and 128.

FIGS. 2 through 4 show that the central slider 112 includes a contour or outer surface 130*a* that is preferably tapered or curved so as to allow a user to easily grasp the sides of the surface 130*a* and thereby either push or pull on the central slider 112 to propel the central slider 112 along the tracks. Outer surface 130*a* preferably includes one or more ends 130*b* upon which the user may push to propel the central slider 112 along the tracks. Note that in some embodiments, as in that shown in FIG. 2, end 130*b* extends out from the central slider 112. In other embodiments, as in that shown in FIGS. 3 and 6B, end 130*b* sits closer in with the rest of the central slider 112 (in FIG. 6B, the embodiment of the end 130*b* located at the left end of the central slider 112 has a curved indentation to more easily accommodate the user's finger when the user pushes against the end 130*b* to propel the central slider 112). A hole 130*c* can be optionally placed in central slider 112 to accommodate a pull cord 140 (see FIG. 2) that further facilitates the user's ability to propel the central slider 112 along the tracks.

Whether the central slider 112 is propelled by pushing or pulling on surface 130*a* or by tugging on pull cord 140, the means for propelling the central slider 112 preferably involves symmetrically balanced pressure exerted by the user upon the central slider 112. In other words, the sum of the user's vector forces exerted on the propulsion means preferably equals a vector force that aligns with the direction of desired movement of the central slider 112 along the tracks. Note that a typical pull tab located on only one side of the central slider 112 would cause the central slider 112 to lean in one direction when the pull tab is pulled; such a propulsion means is not symmetrically balanced.

Figure 6A:
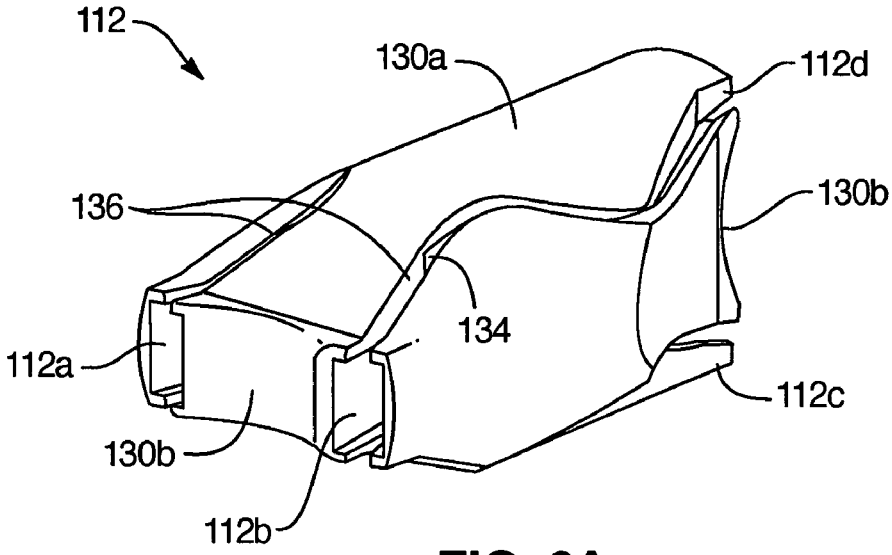
FIG. 6A is a perspective view of another embodiment of a central slider of a transforming fastener of the present invention.
Figure 6B:
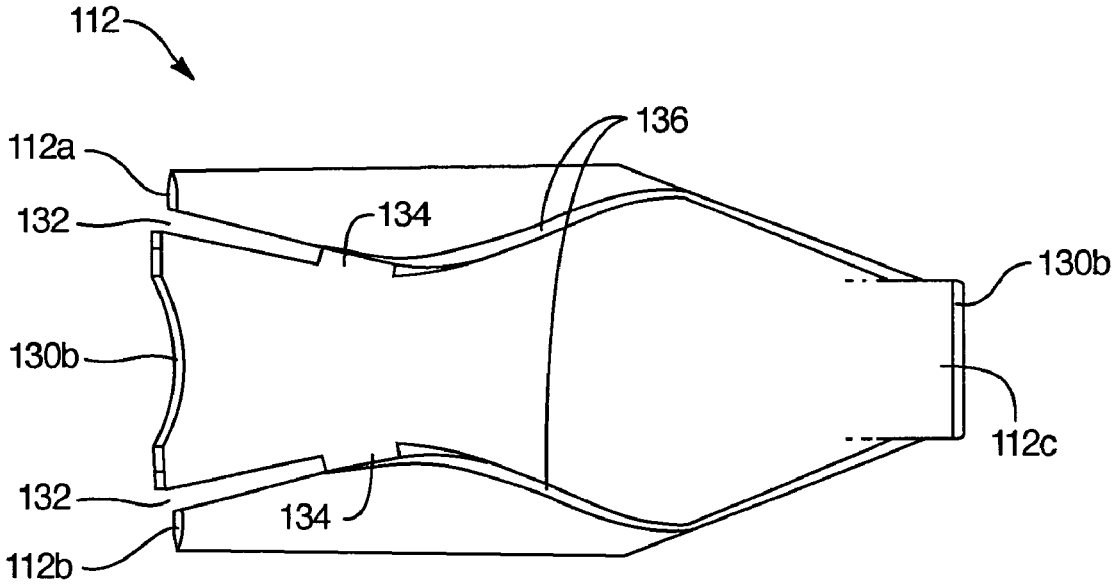
FIG. 6B is a side plan view of the embodiment shown in FIG. 6A.

During the assembly process of some embodiments of the central slider 112, the slider parts 112*a* through 112*d* are placed into the body of the central slider 112. The slider parts 112*a* through 112*d* may be insert molded, injection molded, snapped in, sonic welded, or otherwise coupled to the central slider 112. Some embodiments of the central slider 112, such as those shown in FIGS. 6A and 6B, are made of one integral piece that is formed, for example, by using a single mould.

Central slider 112 can be made of any sort of strong material, including stainless steel and plastic. In some embodiments, central slider 112 is made entirely of aluminum and is substantially hollow, such as the embodiment shown in FIG. 4 which generally resembles a substantially hollow cylinder. A substantially hollow central slider 112 enjoys the added advantage of being lightweight.

FIG. 4 is an exploded perspective view of an embodiment of a central slider 112 having slider parts 112*a* through 112*d* that enable the tracks 114, 116, 118, and 120 to enter and exit the central slider 112 at openings 132 so that the rows are in a closed, zipped-up, or mated state. The slider parts 112*a* through 112*d* cause the mated rows to disengage, preferably via a wedge 134 inside each of paths 136 (described in the next paragraph), in preparation for the row interchange to take place via the paths 136 inside the central slider 112. It will be noted that in the preferred embodiments of the present invention, openings 132 are angled so as to cause the rows to begin to rotate before the rows start to disconnect from each other (via the wedges 134) in preparation for interchange. However, some embodiments of the present invention also contemplate that the openings 132 need not be angled as such.

Central slider 112 includes paths 136 in which the tracks travel, causing the rows of the tracks to interchange as previously described. Paths 136 begin at the slider parts 112*a* through 112*d*, each of which preferably have openings 132 that are angled (for example, at the angle between vertical and the dotted line pointing to slider part 112*b* in FIG. 4) to facilitate the movement of the central slider 112 along the tracks (or, in other words, the movement of the tracks through the central slider 112). Additional preferred features that aid in such movement include: paths 136 that have gradual curves, ideally comprising a flattened or elongated helical shape such as the paths 136 shown in FIGS. 4 through 6B; paths 136 that run substantially through the outer portions of the central slider 112 (again like those shown in FIGS. 4 through 6B), as opposed to through the central cross section of the central slider 112; and paths 136 that are designed so as to allow at least a portion of the tape

122*a*, 124*a*, 126*a*, and 128*a* to move within the paths 136 along with their respective rows. In some embodiments, some or all of these preferred features that aid in moving the central slider 112 along the tracks, together allow the user to pull at the volume of material 10 coupled to the tapes 122*a*, 124*a*, 126*a*, and 128*a* and thereby conveniently propel the central slider 112 along the tracks without having to touch the central slider 112 as further described in the next paragraph. Also, in some embodiments of the present invention, these motion-aiding features serve to prevent or minimize the bunching of the volume of material 10 coupled to the tracks.

In some embodiments wherein the user need not touch the central slider 112 in order to propel it along the tracks, the user can propel the central slider 112 by pulling the sections of the volume of material 10 located on each side of the tracks away from each other. For example, with respect to the embodiment shown in FIG. 1A, a user might lift up his arms up and away from his torso to thereby cause the central slider 112 to slide along the tracks and transform the volume of material 10 from the configuration shown in FIG. 1A to that shown in FIG. 1B. Thus, the user can cause the central slider 112 to propel along the tracks and transform the volume of material 10 without even having to touch the central slider 112 or any extension thereon. In the preferred embodiments, angled openings 132 in the central slider 112 help facilitate this ability to propel the central slider 112 without touching it.

Figure 5A:
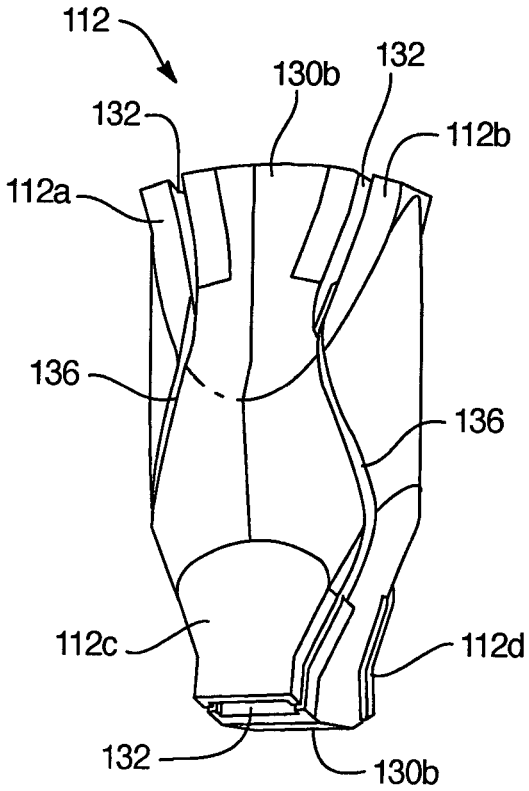
FIGS. 5A through 5C are perspective views of one embodiment of a central slider of a transforming fastener of the present invention.
Figure 5B:
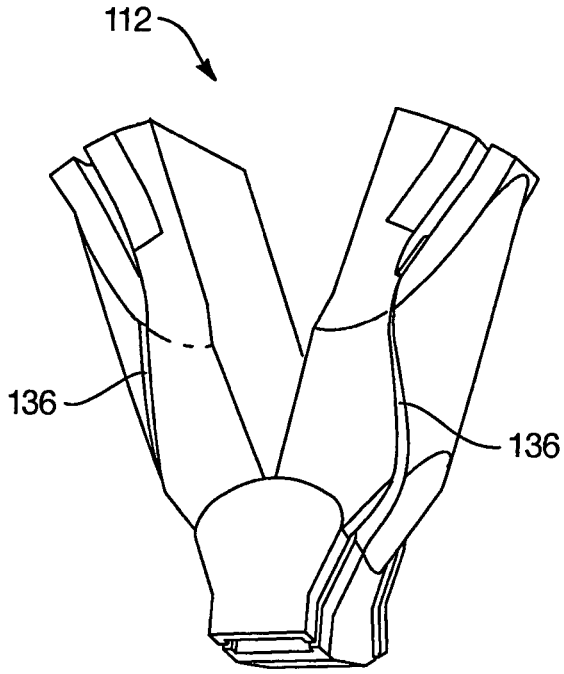
Figure 5C:
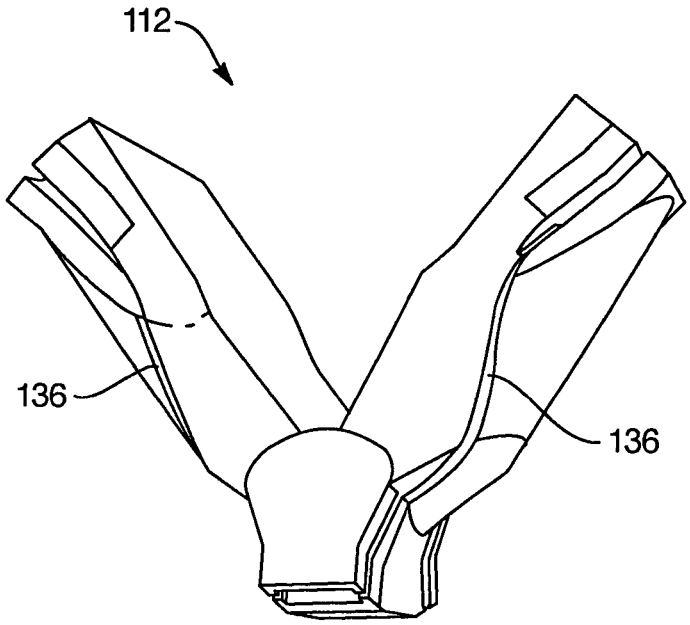

FIG. 5A shows one embodiment of the central slider 112 that has the capability of flaring outwardly by splitting partially apart, as shown in the progression from FIGS. 5A to 5C, when the volume of material 10 near the central slider 112 is pulled at. This flaring capability further facilitates the ability of the central slider 112 to move along the tracks, which, in turn makes it easier for the user to propel the central slider 112 along the tracks without using his hands. Note that the embodiment of the central slider 112 shown in FIGS. 5A through 5C show an example of a central slider 112 that is substantially solid.

Figure 7:
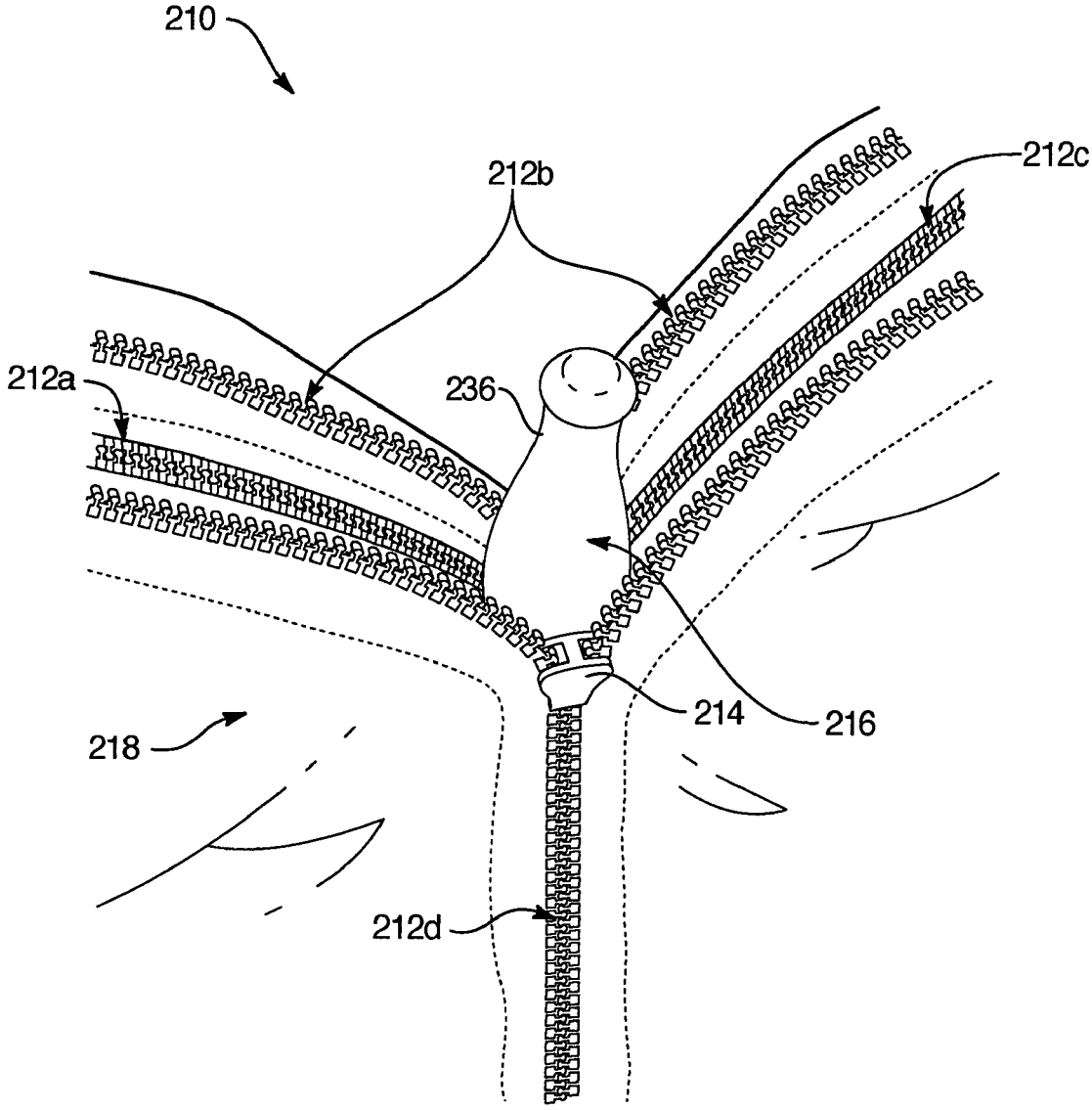
FIG. 7 shows another embodiment of a transforming fastener of the present invention.

FIG. 7 is a perspective view of another embodiment of a transforming fastener 210. This transforming fastener 210 basically comprises four individual tracks, 212*a*, 212*b*, 212*c*, and 212*d* (collectively "212*a*–212*d*"), slider pieces 214*a*, 214*b*, 214*c*, and 214*d* (collectively "214*a*–214*d*") (shown beginning at FIG. 8) on each of the tracks 212*a*–212*d* for fastening or preferably zipping together each of the tracks 212*a*–212*d*, and a central slider connector 216 for centrally connecting each of the slider pieces 214*a*–214*d*. The central connector 216 and/or the slider pieces 214*a*–214*d* comprise possible embodiments of the slider of the transforming fastener 110 of the present invention.

Transforming fastener 210 is attached or sewn to material 218 (comprising part of the volume of material 10) so that when the central connector 216 is pulled in one direction along the tracks, two opposing tracks 212*a* and 212*c* (notice that each track comprises two rows, here shown as zipper teeth) unfasten or unzip, and, simultaneously, the two other opposing tracks 212*b* and 212*d* fasten or zip together. If the central connector 216 were to be pushed in the opposite direction, the tracks that were fastened or zipped together would unfasten or unzip, and the tracks that were unfastened or unzipped would fasten or zip together.

Figure 8:
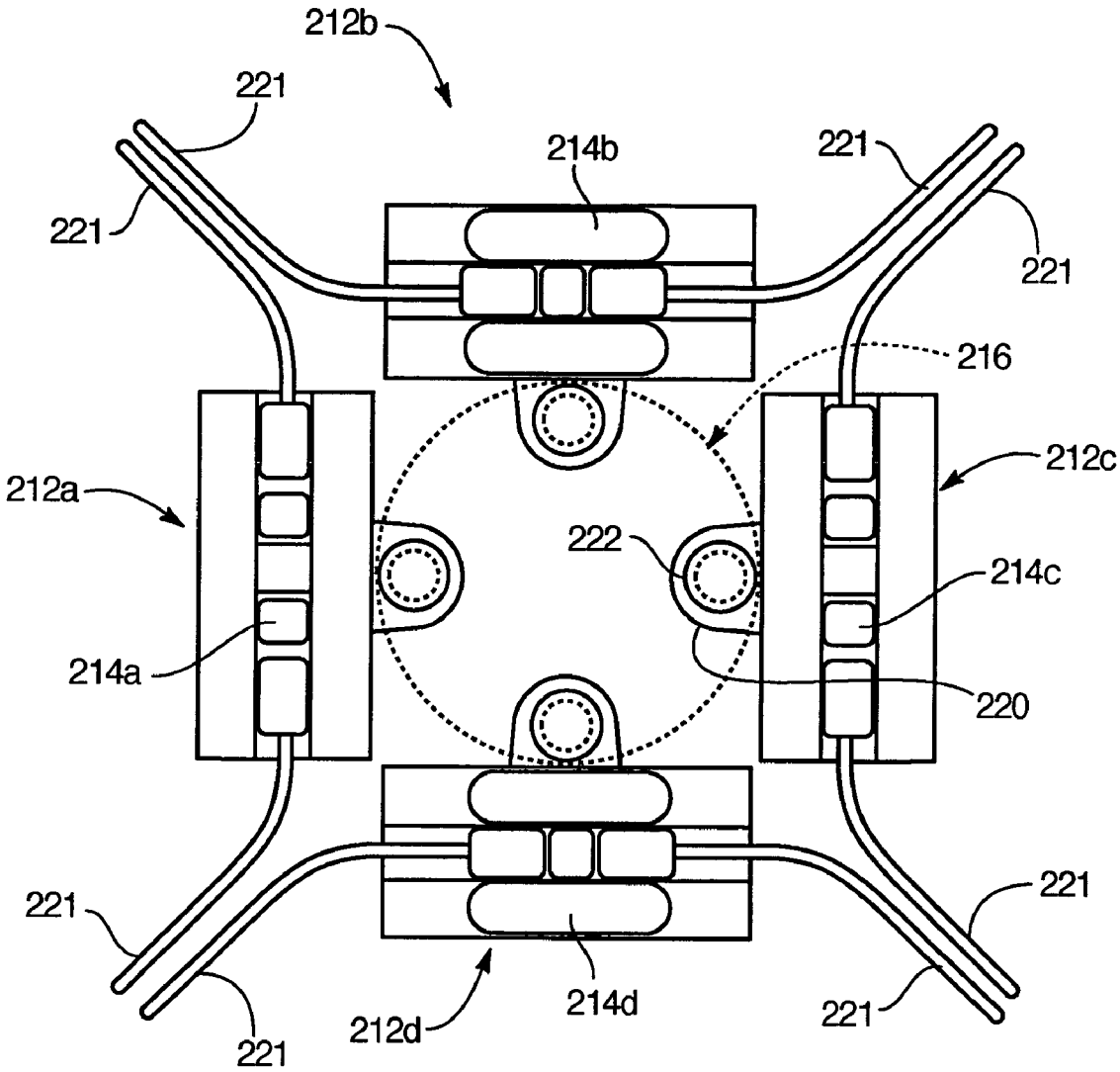
FIG. 8 is a cross sectional plan view of the embodiment of the transforming fastener shown in FIG. 7.

FIG. 8 shows a cross sectional plan view of the transforming fastener 210 of FIG. 7. Shown are four slider pieces 214*a*–214*d* that slide along their respective tracks 212*a*–212*d*. In some embodiments of the present invention, the slider pieces 214*a*–214*d* that are adjacent to each other are oriented in alternating orientations. For example, FIG. 8 shows slider pieces 214*a* and 214*c* to be facing in one direction, and slider pieces 214*b* and 214*d* facing in the opposite direction. This alternating orientation of the slider pieces 214*a*–214*d* causes two of the tracks 212*a*–212*d* to fasten together and two of the tracks 212*a*–212*d* to simultaneously unfasten when the transforming fastener 210 is either pushed or pulled.

Figure 9A:
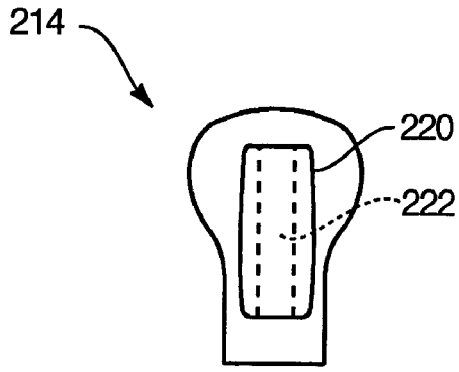
FIGS. 9A through 9C show various views of one embodiment of a slider piece of a transforming fastener, FIG. 9A being an elevational view of the front of the slider piece, FIG. 9B a side elevational view of the slider piece, and FIG. 9C being a top plan view of the slider piece embodiment.
Figure 9B:
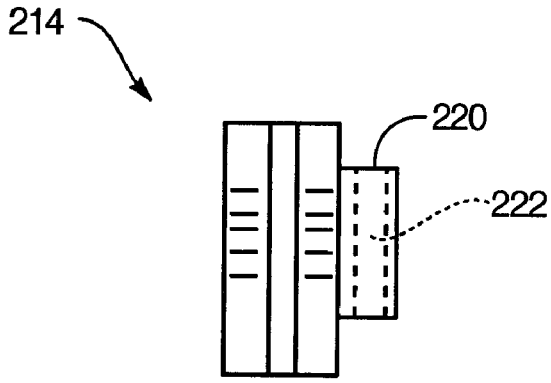
Figure 9C:
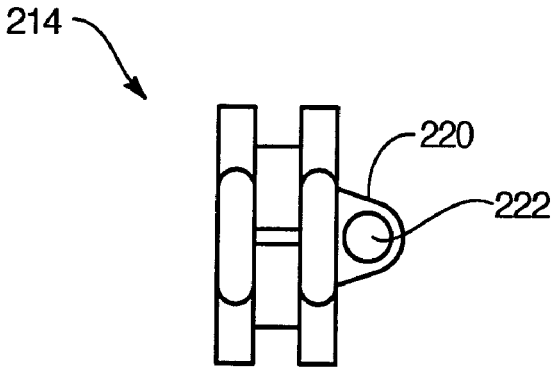
Figure 10A:
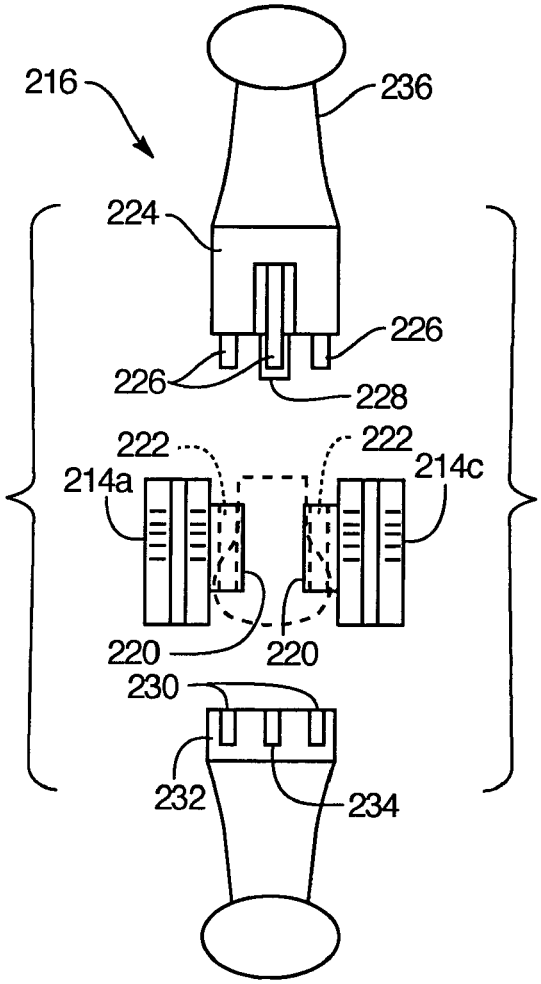
FIG. 10A is an exploded elevational view of one embodiment of a transforming fastener of the present invention.
Figure 10B:
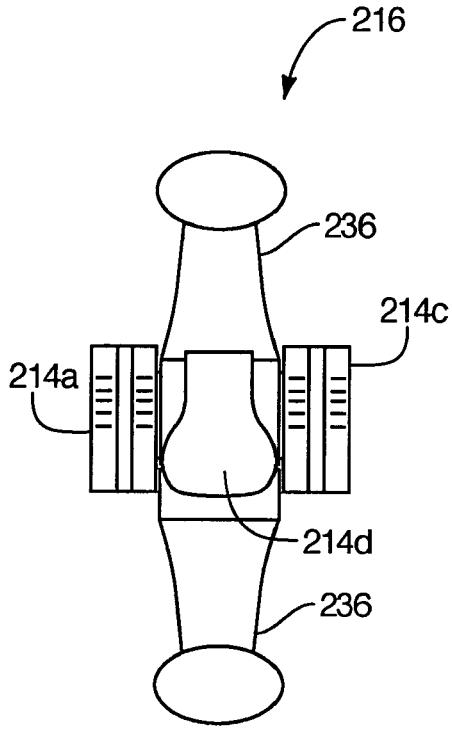
FIG. 10B shows the parts in FIG. 10A when connected together.
Figure 11A:
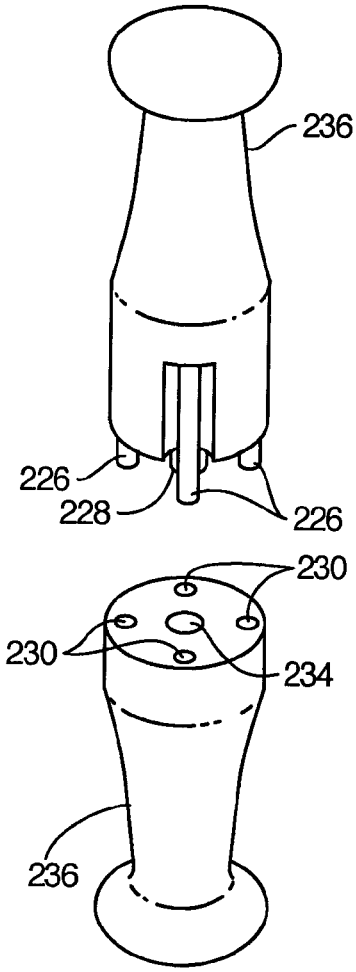
FIG. 11A is a perspective view of part of the transforming fastener shown in FIGS. 10A and 10B.
Figure 11B:
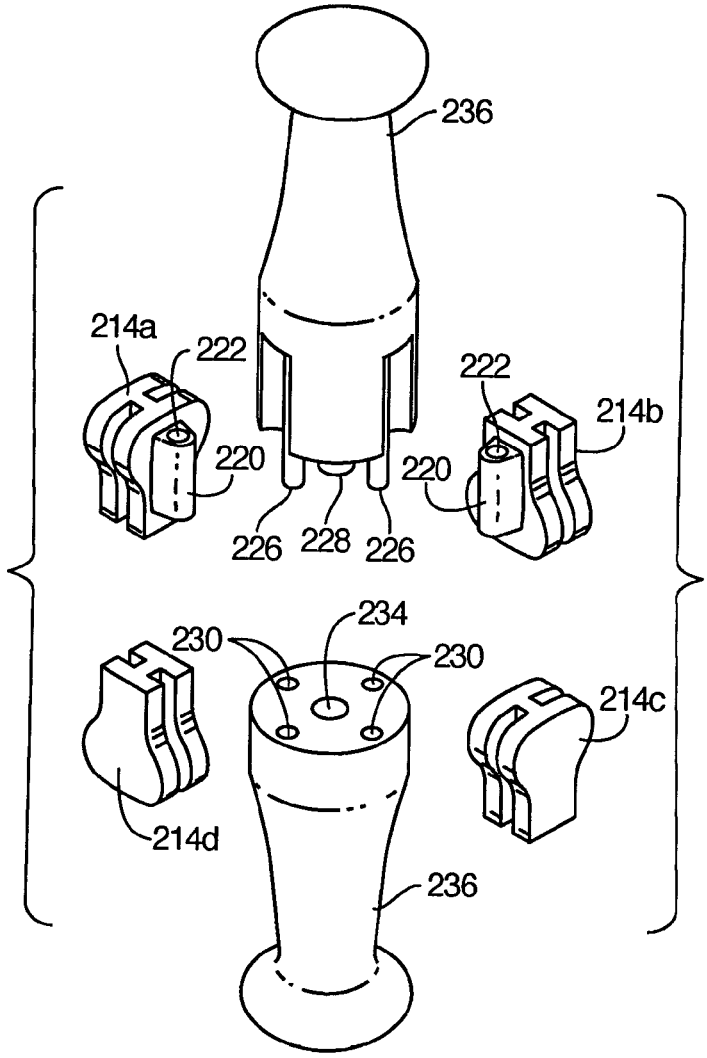
FIG. 11B is a perspective view of the embodiment shown in FIG. 10A.

FIG. 8 also shows a cross section of the central connector 216 to which the slider pieces 214*a*–214*d* are connected in accordance with some embodiments of the present invention. The slider pieces 214*a*–214*d* may be connected to the central connector 216 in any appropriate way. For example, the central connector 216 and slider pieces 214*a*–214*d* may be all integrally formed—instead of comprising parts that are initially separate and then subsequently coupled together. In the embodiment shown in FIG. 8, the slider pieces 214*a*–214*d* each have an extension 220 (commonly known in the zipper manufacturing industry as a "nose piece") by which the slider pieces 214*a*–214*d* are connected to the central connector 216. Note that extension 220 has a hole 222 (shown also in dotted lines in FIGS. 9A and 9B). As can be seen in the various views of the slider piece 214 (slider piece 214 being representative of one of the slider pieces 214*a*–214*d*) in FIGS. 9A, 9B, and 9C, this particular extension 220 is specially molded because the hole 222 is a longitudinally oriented hollow instead of a horizontally oriented hollow. However, in some embodiments, it may instead be more cost effective to produce the transforming fastener 210 using standard zipper slider moulds.

In some embodiments of the present invention, the slider pieces 214*a*–214*d* are oriented in a ring-like formation, as shown in FIG. 8. Moreover, each track 212*a*–212*d* has edges 221 that are attached or sewn to the edges 221 of the adjacent track. As such, the orientation of the slider pieces 214*a*–214*d* causes two opposing tracks (for example, tracks 212*a* and 212*c*) to zip together and the other two opposing tracks (for example, 212*b* and 212*d*) to simultaneously unzip when the central connector 216 is either pushed or pulled.

As shown in FIGS. 10A through 11B, one embodiment of the central connector 216 may comprise a male piece 224 and a female piece 232 wherein the male piece 224 has peripheral extensions 226 that, during the assembly process, are inserted into the holes 222 of the slider piece extensions 220. The peripheral extensions 226 are then inserted into complementary peripheral receiving holes 230 in the female piece 232. A central extension 228 on the male piece 224 is also received by a central receiving hole 234 in the female piece 232. The central extension 228 and/or the peripheral extensions 226 are secured into their respective holes 234 and 230 so that the male piece 224 and the female piece 232 are securely attached, thereby ensuring a reliable connection between the slider pieces 214*a*–214*d* and the central connector 216. In some embodiments, the central extension 228 and/or the peripheral extensions 226 may have a flange around the tip (not shown), which allows the male piece 224 to snap or lock into the female piece 232.

The central connector 216 also comprises a handle (various examples of which are identified by number 236 in FIGS. 7 and 10A through 11B, and by the combination of the elements identified by numbers 242, 248, and 250 in FIGS. 12A and 12B) whereby the central connector 216 can be pushed or pulled. The handle on the central connector 216 may comprise a surface on the central connector 216 or may be an additional piece attached to the central connector 216. The handle can be shaped in any suitable manner that allows a person to either push the handle in a first direction along the tracks, thereby sliding the central connector 216 in the first direction along the tracks 212*a*–212*d*, or pull the handle in an opposite second direction, thereby sliding the central connector 216 in the opposite direction along the tracks 212*a*–212*d*. The central connector 216 need not include a handle; alternatively, it may include any number of handles.

In the embodiment shown in FIGS. 10A through 11B, two handles 236 (the handles shown here each being shaped like a milk bottle) are available to manipulate the central connector 216. When incorporated into a volume of material 10, for example, this central connector 216 might have one handle 236 extending into the interior of the volume of material 10, and one handle 236 extending exteriorially away from the interior of the volume of material 10. Thus, a user is able to propel the central connector 216 by accessing it from within the interior of the volume of material 10 (via the interior handle 236); the user may also propel the central connector 216 by accessing it from a point exterior to the volume of material 10 (via the exterior handle 236). FIG. 7 illustrates an example of such a double-handled embodiment. However, note that only the exterior handle 236 is visible in FIG. 7.

Figure 12A:
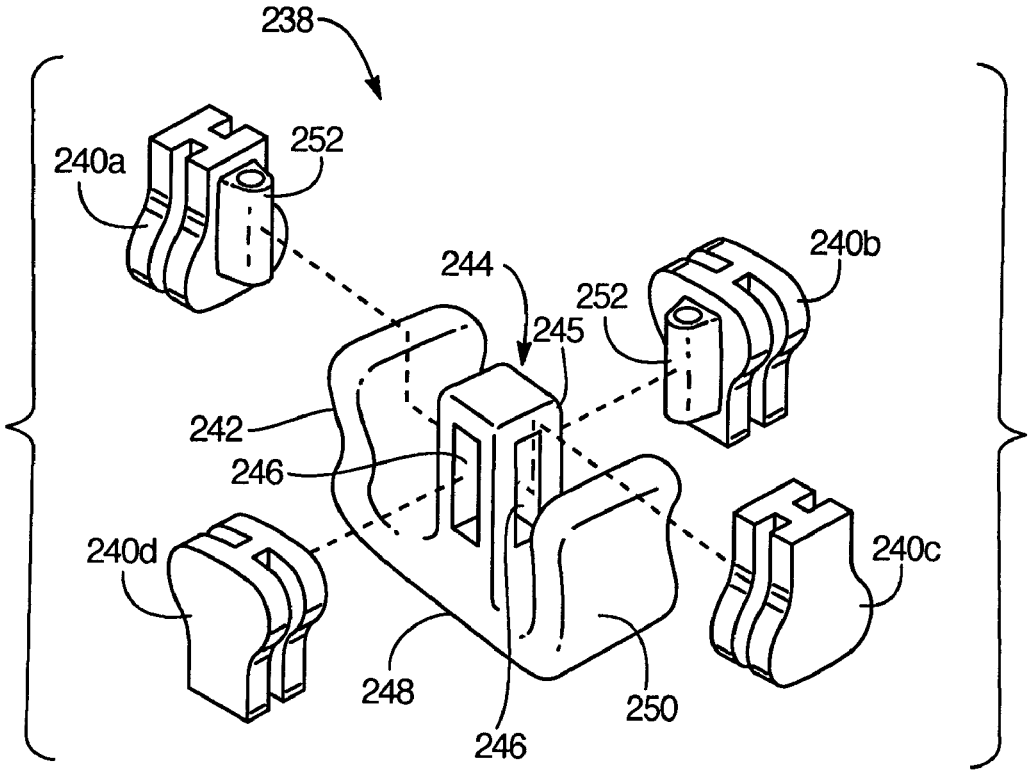
FIG. 12A is an exploded perspective view showing one embodiment of the slider pieces and the central connector of a transforming fastener.
Figure 12B:
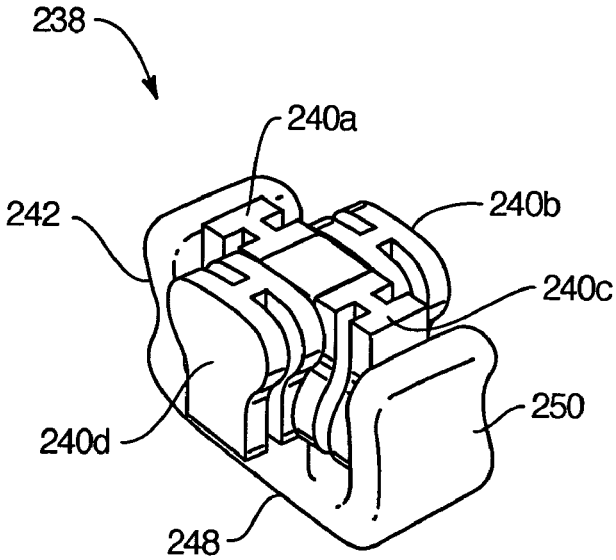
FIG. 12B is a perspective view of the embodiment shown in FIG. 12A when the pieces in FIG. 12A are assembled together.

FIGS. 12A and 12B illustrate an embodiment of a central connector 238 that is integrally formed with slider pieces 240*a*, 240*b*, 240*c*, and 240*d* (collectively "240*a*–240*d*"), preferably using the process of insert molding. Here, the central connector 238 includes a central piece 244 that holds the slider pieces 240*a*–240*d*. The central piece 244 and the slider pieces 240*a*–240*d* can be any shape; this particular central piece 244 has a center post 245, a first side 242, a second side 250, and a bottom surface 248 (the latter three elements of which can together comprise a handle, as explained further herein). The center post 245 further includes slots 246 for receiving extensions 252 on the slider pieces 240*a*–240*d*. Assembling this central connector 238 via insert molding involves placing the slider pieces 240*a*–240*d* within a mould and shooting plastic around the slider piece extensions 252 to create the plastic central piece 244, the result being an integrally formed central connector 238 comprising the central piece 244 and the slider pieces 240*a*–240*d*. Note that in some of the embodiments, the central piece 244 is plastic, and the slider pieces 240*a*–240*d* are metal.

It was mentioned earlier that the embodiment in FIGS. 12A and 12B has a handle that is formed integrally with the central connector 238 and comprises a contour or surface of the central connector 216. This handle is comprised of sides 242 and 250 and/or the bottom surface 248. The handle of this embodiment is designed to be incorporated in material 218 so that the sides 242 and 250 and bottom surface 248 are exteriorly located with respect to the interior of the volume enclosed by the material 218. In other words, if this handle were substituted for the handle 236 in FIG. 7, the bottom surface 248 is what would be visible in the drawing. In order to move the central connector 238 along the tracks 212*a*–212*d*, a user can grasp the handle of FIGS. 12A and 12B at sides 242 and 250 with a thumb and forefinger. The user can also push against the bottom surface 248 to move the central connector 238 along the tracks 212*a*–212*d*.

The transforming fastener 210, being a specific embodiment of the transforming fastener 110 of the present invention, can likewise transform the volume of material 10 between a first undivided formation comprising a sleeveless cape, and a second divided formation comprising a sleeved cape. For example, FIGS. 1A and 1B show two transforming fasteners 110 incorporated into a volume of material 10 having material comprising sleeves 12. If the transforming fasteners 110 in FIG. 1A were the specific transforming fasteners 210, the transforming fasteners 210 would be in a state wherein two opposing tracks within each transforming fastener 210 are zipped closed so that the volume of material 10 is useful as a cape for enclosing the user's torso and arms together in one compartment, for example. Of course, since the slider pieces 214*a*–214*d* in the transforming fasteners 210 are in alternating orientations, the other two tracks within each transforming fastener 210 are in an unzipped state in FIG. 1A.

Continuing with the analogy, if the transforming fasteners 110 in FIG. 1B were the specific transforming fasteners 210, then the transforming fasteners 210 that were closed in FIG. 1A would be open in FIG. 1B; those that were open in FIG. 1A would be closed in FIG. 1B. As a result, the volume of material 10 in FIG. 1B would be useful as a sleeved jacket, for example.

Figure 13B:
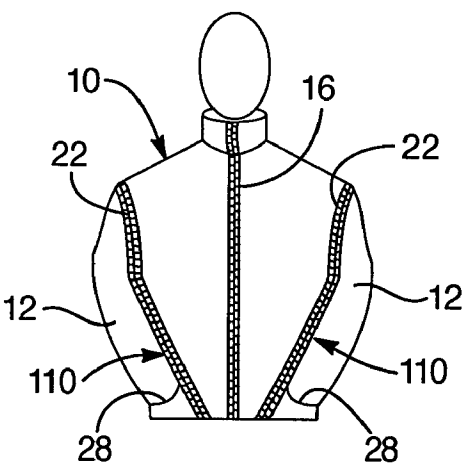
FIGS. 13A through 13C illustrate various embodiments of the present invention.
Figure 13A:
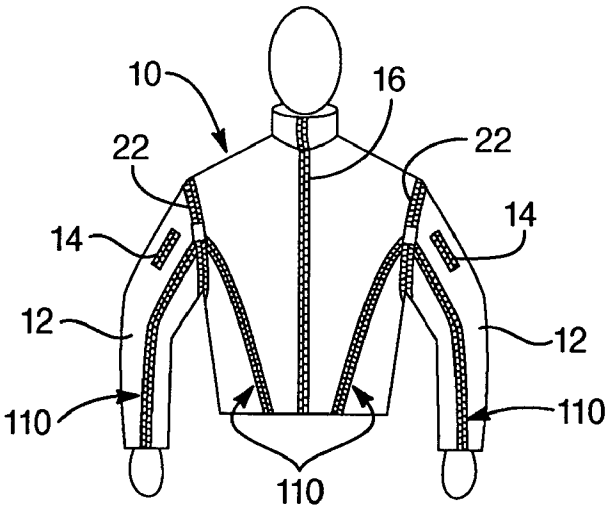
Figure 13C:
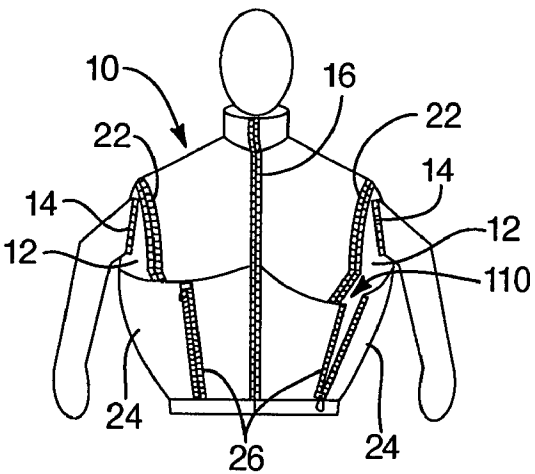

FIGS. 13A through 13C show various embodiments of the present invention, herein sometimes referred to generally as "capes," wherein each of the Figures show only the front sides of the volumes of material 10. It should also be noted that the transforming fasteners 110 shown in FIGS. 13A through 13C can represent the transforming fastener 210 or any other particular embodiment of the transforming fastener 110 of the present invention.

FIGS. 13A through 13C show an optional standard zipper 16 coupled to the volume of material 10 in accordance with some embodiments of the present invention. The standard zipper 16 can be used to allow a user to enter or exit the volume of material.

In the preferred embodiments of the present invention, some of the tracks of the transforming fasteners dividing the volume of material 10 into separate compartments comprising sleeves 12 are placed diagonally on the front side of the volume of material 10 as shown in FIGS. 13A through 13C. Placing the tracks diagonally as such is intended to make it easier for the sliders of the transforming fasteners 110 to slide along the tracks; it also helps reduce the overall width of the volume of material 10 as measured between the two sleeves 12.

In some embodiments of the present invention, as with those discussed at the beginning of this Detailed Description in conjunction with FIGS. 1A and 1B, two of the matable rows of each transforming fastener 110 are coupled to the front side of the volume of material 10, and two of the matable rows are coupled to the back side immediately behind the front matable rows. In some embodiments, the tracks are coupled to the inseams of the sleeves 12 as shown. In other words, one method of assembly involves first obtaining a pre-existing volume of material 10 having inseams (such as a jumpsuit), and then coupling the transforming fasteners 110 to the inseams. However, assembly can include cutting a new slit in a desired location in the volume of material 10, and then coupling the transforming fasteners 110 to that slit. The latter method is the preferred method for placing the tracks diagonally on the front of the volume of material 10.

Turning again to FIGS. 13A through 13C, FIG. 13A shows standard zippers 14 that may be placed in the sleeves 12 of some embodiments of the present invention. A user may unzip the standard zippers 14 to create a hole that might be used for various purposes, including as a heat vent, or as a means by which the user can extend his arms outside of the volume of material 10. In some embodiments, the user can pull the sleeves 12 through the hole and into the interior of the volume of material 10. The user can then extend his arms back out through the hole so that his arms are exposed to the environment while the sleeves 12 are tucked inside the interior of the volume of material 10.

In some embodiments of the present invention, such as the embodiment in FIG. 1B discussed near the beginning of this Detailed Description, the user's hands are always encased by the volume of material 10. In the preferred embodiments, such as those shown in FIGS. 13A through 13C, the volume of material 10 has arms 12 that are open at the wrists so that the user's hands can extend therethrough. In some embodiments of the present invention, the volume of material 10 has pockets 28 (see FIG. 13B) into which the user can place his hands. Preferably, these pockets 28 are placed in the volume of material 10 so that the ends of the sleeves 12 can be enclosed by the pockets 28 when the volume of material 10 is in the first undivided formation as shown in FIG. 13B.

FIG. 13C additionally shows optional flaps 24 that allow the user to secure the volume of material 10 in a position closer to the user's body. Flaps 24 are shown here as comprising a piece of material coupled to the exterior of the volume of material 10 at the sides of the standard zipper 16 and at the sides and bottom of the volume of material 10. The preferred flaps 24 have standard zipper 26 incorporated therein so that the flaps 24 can be unzipped to allow the user's arms and sleeves 12 to enter therein. In some embodiments, the user can also place his hands in pockets 28 located interior to the flaps 24. This way, the user can rest his arms against the interior of the flaps 24 while his hands are in the pockets 28. In some embodiments, the user can further unzip standard zippers 14 to allow the user's arms to extend from the volume of material 110 and wear it as a vest, as seen in FIG. 13C.

In addition, some embodiments of the invention, as can be seen in the embodiments shown in FIGS. 13A through 13C, include a standard zipper 22 for partially unzipping the sleeves 12.

In the preferred embodiments, the slider of the transforming fastener 110 is placed near the armpits. One advantage of placing the slider of the transforming fastener 110 near the armpits is the ability of the user to propel the slider by accessing it from within the interior of the volume of material 10. For example, the user, when wearing a volume of material 10 in the second formation wherein the sleeves 12 comprise separate compartments, may simply reach his hands up from within the volume of material 10 and push downwards on a slider to cause it to travel downward along the tracks and thereby transform the volume of material 10 into the first, sleeveless formation.

It can be observed from the transformations shown in FIGS. 1A, 1B, and 13A through 13C that the transformations caused by the transforming fasteners 110 do not change the quantum of volume enclosed by the volume of material 10; the transformations merely compartmentalize or divide up the volume. However, not all embodiments require a fixed quantum of enclosed volume. For example, in embodiments wherein the central slider 112 is designed to be removable from some of the rows, a first volume might be attachable to a second volume via the central slider 112 to create a third volume equal to the sum of the first and second volumes.

Figure 14:
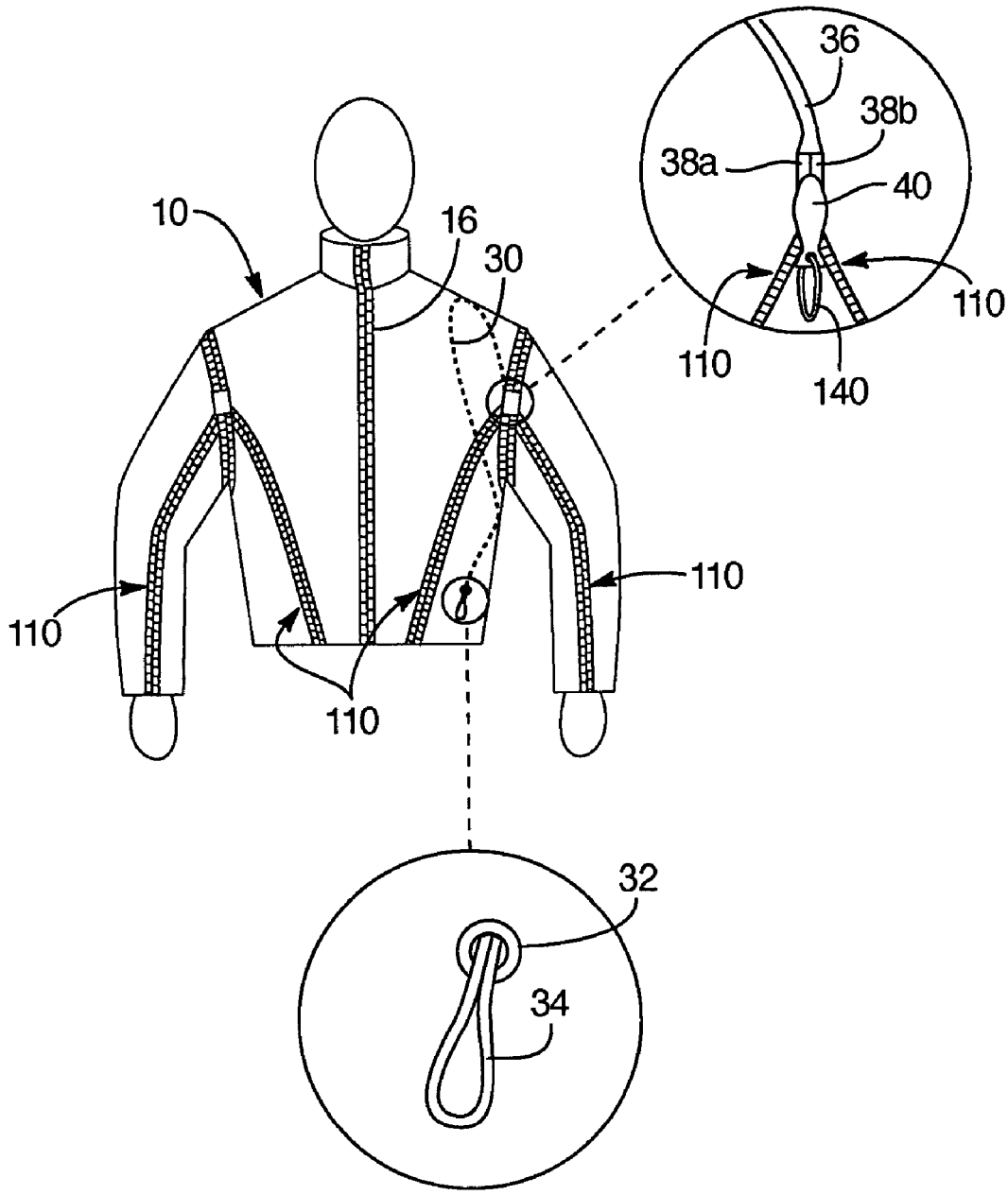
FIGS. 14 and 15A through 15D illustrate a stabilizing system in accordance with some embodiments of the present invention.

Turning now to FIGS. 14 and 15A through 15D, these Figures illustrate a stabilizing system incorporated into the volume of material 10 in some embodiments of the present invention. In FIG. 14, one end of a cord or cord-like device 36 is fixed to tapes 38*a* and 38*b* of a transforming fastener 110. The cord 36 runs loosely along the insides of the fabric comprising the volume of material 10, preferably through a path 30 within lining in the volume of material 10. The cord travels through the path 30 over the user's shoulder, down the user's back, and around the user's side to return to the front of the volume of material 10. The other end of the cord 36 exits through a hole 32 near the bottom of the relevant transforming fastener 110. At this end, the cord 36 preferably comprises a loop 34.

To operate the stabilizing system of FIG. 14, the user tugs downwards on the loop 34 with one hand to stabilize the transforming fastener 110 that he intends to operate. While tugging downwards on the loop 34 with one hand, the user uses his other hand to pull a slider 40 on the transforming fastener 110 downwards by either grasping the slider 40 itself or by grasping a pull cord 140 on the slider 40. By doing this, the user creates tension at the top of the tracks where the cord 36 meets the tapes 38*a* and 38*b* of the transforming fastener 110, thereby smoothing out the tracks to enable the slider 40 to slide down the tracks more effectively.

Figure 15A:
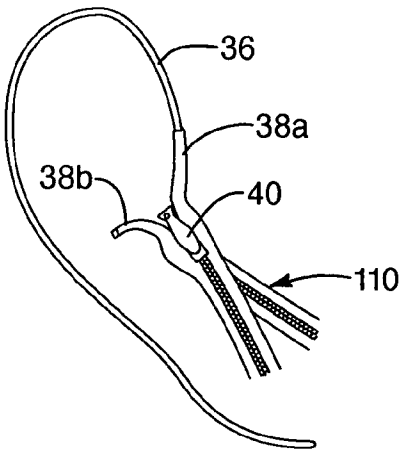

FIGS. 15A through 15D show various other embodiments of the stabilizing system. FIG. 15A shows a stabilizing system in which only the end of one of the tapes 38*a* is coupled to a cord 36 that operates as just previously described.

Figure 15B:
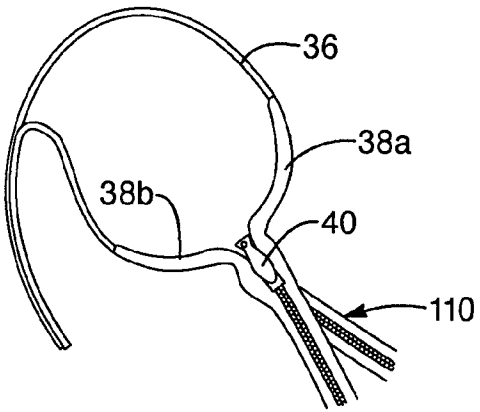

The stabilizing system of FIG. 15B operates similarly to the system described in conjunction with FIG. 14 except that the tapes 38*a* and 38*b* are anchored or sewn to the volume of material 10 at a location near the armhole of the relevant sleeve 12. Anchoring the tape ends 38*a* and 38*b* to the volume of material 10 adds even more stability to the stabilizing system.

Figure 15C:
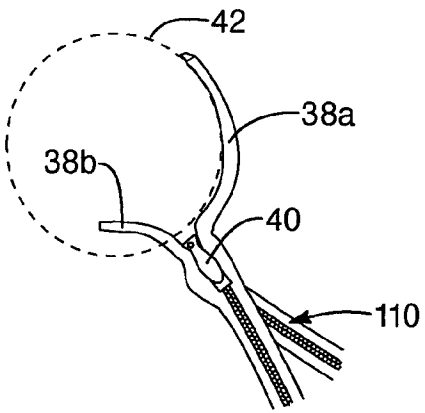

FIG. 15C shows a stabilizing system similar to that of FIG. 15A, except that the end of the tape 38*a* is anchored or sewn to the volume of material 10 at a location nearby armhole 42—instead of being coupled to a cord 36.

Figure 15D:
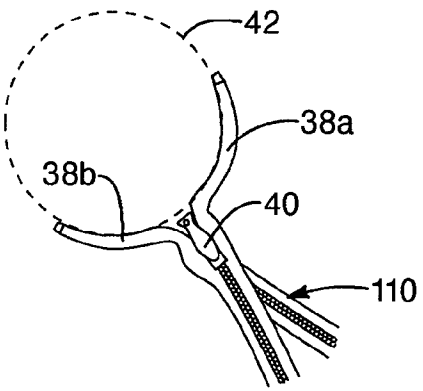

FIG. 15D shows a stabilizing system similar to that of FIG. 15B, except that the tape ends 38*a* and 38*b* are anchored or sewn to the volume of material 10 at a location nearby the armhole 42—instead of being coupled to a cord 36.

FIGS. 16A through 16D illustrate an infant carrying device coupled to the inside of the volume of material 10, the volume of material 10 here being referred to also as a cape or cloak. The infant carrying device basically comprises a harness 56 coupled to the interior of the cloak, a carrier cloth 52 coupled at one end to the harness 56, and coupling means 50 for coupling the other loose end of the carrier cloth 52 to the harness 56. Preferably, the coupling means 50 comprises a pair of rings, one pair near each of the user's shoulders. The user may couple the loose end of the carrier cloth 52 to the rings 50 by intertwining the cloth 52 through the rings 50.

Figure 16A:
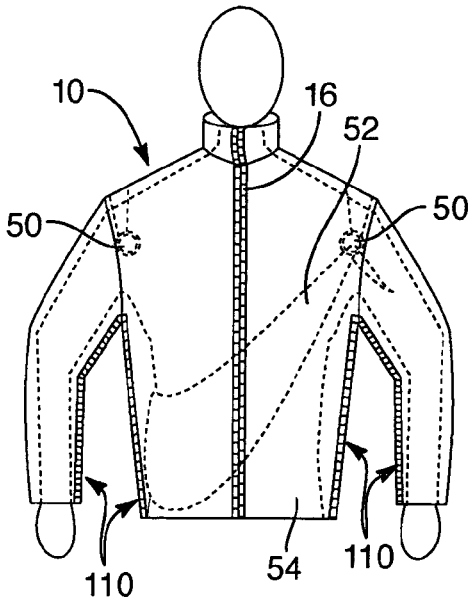
FIGS. 16A through 16D illustrate an infant carrying device in accordance with some embodiments of the present invention.
Figure 16B:
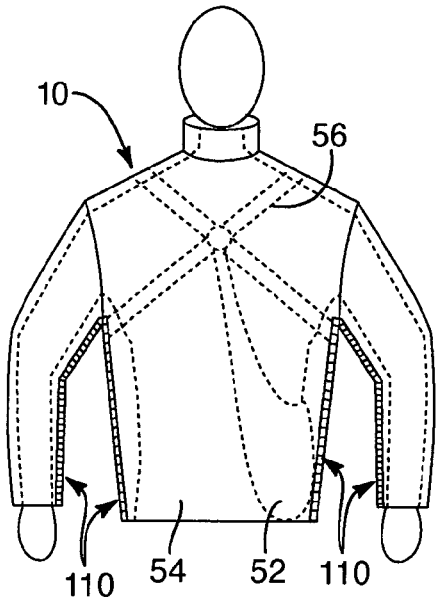
Figure 16C:
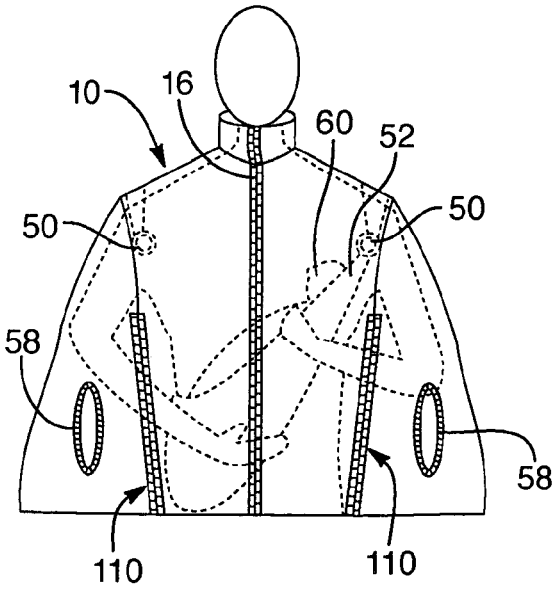
Figure 16D:
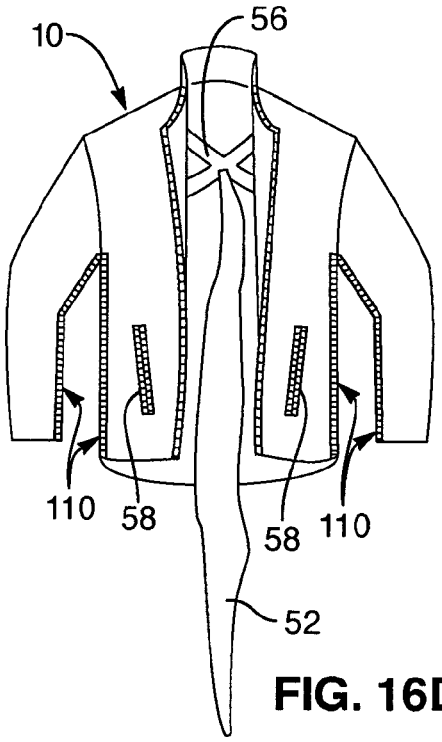

To use the infant carrying device, the user puts on the cloak or volume of material 10, proceeds to bring the loose end of the carrier cloth 52 around the user's body 54, and couples the loose end of the carrier cloth 52 to the coupling means 50, as seen in FIGS. 16A and 16B. In some embodiments, as in those shown here, the user may select to couple the loose end of the carrier cloth 52 to the pair of rings 50 near either of the user's shoulders. The user then places an infant 60 or other baggage in the carrier cloth 52 as shown in FIG. 16C. The user may then close up the cloak or volume of material 10 using a standard zipper 16, for example. The transforming fasteners 110 can be used as previously described herein to transform the cloak between a sleeved and sleeveless formation as desired by the user. Optional expansion means 58 (see FIGS. 16C and 16D) are preferably standard zippers that may be placed in the cloak or volume of material 10 to allow the user to vary the width of the cloak. FIG. 16C shows the expansion means 58 in an unzipped state that allows the width of the cloak to be expanded. FIG. 16D shows the expansion means 58 in a zipped-up state wherein the expansion means 58 is not performing its expansion functions.

FIG. 16D shows the loose end of the carrier cloth 52 extending from the harness 56. In some embodiments, the loose end of the carrier cloth 52 can be tucked inside the volume of material 10 when not in use. Also, in some embodiments, the carrier cloth 52 can be completely detached from the harness 56 and stored away for later use.

In summary, the present invention provides various types of capes that allow a user or occupant to conveniently transform between a sleeveless cape and a sleeved cape without having to exit the cape and expose himself or herself to the environment. In the outdoor context, one of these capes might be a rain poncho that is transformable, without requiring the user to be exposed to the climate, into a jacket or parka. In other contexts, the capes of the present invention might comprise a wearable cape inside which a mother could carry a baby while keeping the baby covered from the outside environment. The wearable cape could then be transformed into a sleeved jacket that the mother could use when she does not desire to carry the baby. These and various other embodiments of the present invention provide exceptional flexibility, versatility, and convenience to the user.

It should be emphasized that the present invention is not limited to the specific examples described in this Detailed Description. For example, the sliders, slider pieces, slider parts, central slider, central connector, tracks, handle, volume of material, and various other parts of the present invention all may be made of any material and be made into any shape that will accomplish the functions of the present invention. Also, any two or more of the various elements of the present invention, including the latter listed elements, may be manufactured as a single whole part instead of as pieces manufactured separately and then subsequently coupled together.

It is underscored that the present invention may be embodied in other specific forms without departing from its spirit or essential characteristics. The described embodiments herein should be deemed only as illustrative. Indeed, the appended claims indicate the scope of the invention; the description, being used for illustrative purposes, does not limit the scope of the invention. All variations that come within the meaning and range of equivalency of the claims are to be embraced within their scope.

What is claimed is:

1. A system comprising:

a volume of material having a first formation wherein the volume is substantially undivided by the material, and a second formation wherein the volume is substantially divided by the material, said first formation being shaped so as to enclose a user's torso and arms together in one compartment, said second formation being divided so as to form compartments suitable for separately enclosing each of the user's arms;

a transforming fastener coupled to the volume of material, said transforming fastener comprising:

a plurality of tracks, each track comprising a pair of matable rows; and a slider slidably coupled to the rows, the slider transforming said volume of material, when sliding along said rows, between said first and second formations by fastening one of the pair of rows while unfastening another of the pair of rows.

2. The system of claim 1 wherein said second formation comprises sleeves, said sleeves further comprise inseams, and said tracks are coupled to the inseams.

3. The system of claim 1 wherein said second formation comprises sleeves, said transforming fastener comprises a first end and a second end, said first end is placed at the armpit of said sleeves, and said second end is placed near the general location of the user's wrists.

4. The system of claim 1 wherein said first formation completely encloses the user's arms and hands.

5. The system of claim 1 further comprising a standard zipper coupled to the volume of material near the user's shoulder, said standard zipper allowing the user's arm to exit the volume of material.

6. The system of claim 1 wherein the user may propel the slider along the rows by accessing the slider from within the jacket.

7. The system of claim 1 further comprising a stabilizing system for steadying the transforming fastener while the user propels said slider along said rows.

8. The system of claim 1 wherein stretchable fabric is placed between the tracks and the volume of material to facilitate movement of the slider along the matable rows.

9. The system of claim 1 further comprising a means for carrying an infant within the volume of material.

10. The system of claim 1 further comprising flaps for holding said volume of material in towards the user's torso.

11. The system of claim 1 further comprising means for propelling the slider along the tracks.

12. The system of claim 1 wherein the movement of the slider along the rows causes the rows to interchange with each other.

13. The system of claim 1 wherein the volume of material transforms from the first formation into the second formation when the user wearing the volume of material lifts his arms up and away from his torso.

14. The system of claim 1 wherein said slider has a contour upon which the user may both push and pull in order to propel the slider along the matable rows.

15. The system of claim 1 wherein said slider is coupled to at most four tracks and said slider comprises four zipper sliders affixed to a central connector, each of said four zipper sliders being coupled to one of the four tracks.

16. The system of claim 1 wherein said slider comprises a central slider comprising:

a first end and a second end, an angled opening at each end of the central slider, said angled openings being shaped to facilitate rotation of the tracks within the central slider; and a plurality of paths in said central slider, said paths through which the tracks travel when the central slider slides along the tracks, the paths thereby causing the rows of the tracks to interchange.

17. A system comprising:

a volume of material wearable by a user, said material comprising a cape for encasing the user's torso and arms, said cape comprising a front side and a back side;

a transforming fastener coupled to the cape, said transforming fastener comprising:

a plurality of tracks, each track comprising a pair of matable rows, two of the matable rows being coupled to the front side of the cape, and two of the matable rows being coupled to the back side of the cape; and a slider slidably coupled to the rows, the slider dividing said cape, when sliding along said rows, into sleeves by fastening one of the pair of rows while simultaneously unfastening another of the pair of rows.

18. The system of claim 17 wherein said sleeves further comprise inseams, and said tracks are coupled to and along the inseams.

19. The system of claim 17 wherein some of said tracks are diagonally coupled to said front side of said cape.

20. The system of claim 17 further comprising:

flaps for holding in said sleeves towards the user's torso; and pockets underneath said flaps for the user to place his hands in.

21. The system of claim 17 wherein the movement of the slider along the rows causes the rows to interchange with each other.

22. The system of claim 17 further comprising an anchor coupled to the volume of material for stabilizing said transforming fastener when the user propels the slider along said tracks.

23. The system of claim 17 further comprising a stabilizing cord coupled to the volume of material for stabilizing said transforming fastener when the user propels the slider along said tracks.

24. The system of claim 17 further comprising a stabilizing system coupled to the volume of material, said stabilizing system comprising at least one anchor and at least one stabilizing cord.

25. The system of claim 17 wherein the volume of material transforms into the sleeves without use of the user's hands.

26. The system of claim 17 wherein said slider can split partially apart to facilitate movement of the slider along the tracks when the user lifts his arm up away from his torso to help propel the slider along the tracks.

27. The system of claim 17 wherein said slider has a curved contour upon which the user may push and pull in order to propel the slider along the matable rows.

28. The system of claim 17 wherein said slider is coupled to at most four tracks and said slider comprises four zipper sliders affixed in a ring-like formation to a central connector, each of said four zipper sliders being coupled to one of the four tracks.

29. The system of claim 17 wherein said slider comprises a central slider comprising:

a first end and a second end;

an angled opening at each end of the central slider, said angled openings being shaped to facilitate rotation of the tracks within the central slider; and a plurality of paths in said central slider, said paths through which the tracks travel when the central slider slides along the tracks, the paths thereby causing the rows of the tracks to interchange, said central slider being shaped so that the rotation of the tracks within said central slider begins while the rows are being disconnected from each other in preparation for said interchange.

30. The system of claim 17 wherein the volume of material has the same quantum of volume before and after said dividing takes place.

31. The system of claim 17 further comprising an expansion zipper coupled to said volume of material.

32. The system of claim 17 further comprising pockets into which the user can place his hands and the ends of the sleeves.

33. The system of claim 17 wherein said rows comprise zipper teeth.

34. A system comprising:

a volume of material comprising a cape for encasing a user's arms and torso;

a plurality of tracks coupled to the volume of material, each track comprising a pair of matable rows; and a means, coupled to said volume of material, for dividing said cape into compartments comprising sleeves.

35. The system of claim 34 further comprising a standard zipper coupled to the volume of material, said standard zipper allowing the user's arm to extend from the volume of material as well as acting as an optional heat vent.

36. The system of claim 34 further comprising a means for stabilizing said means for dividing.

37. The system of claim 34 further comprising:

a harness coupled to the inside of the cape;

a carrier cloth having a first end and a second end, the first end being removably coupled to the harness; and coupling means for coupling said volume of material with said second end of the carrier cloth.

38. The system of claim 34 further comprising:

zippered flaps for holding in said sleeves towards the user's torso; and pockets coupled to the volume of material and underneath said flaps for the user to place his hands in.

39. The system of claim 34 wherein the volume of material has the same quantum of volume before and after said dividing takes place.

40. A system comprising:

a jacket wearable by a user, said jacket comprising a front side, a back side, an armpit, and a bottom end;

a transforming fastener coupled to the jacket, said transforming fastener comprising:

a plurality of tracks, each track comprising a pair of matable rows, the tracks having a first end coupled to the jacket near the armpit and a second end coupled to the bottom end of the jacket; and a slider slidably coupled to the rows, the slider dividing sleeves from said jacket, when the slider slides along said rows, by fastening one of the pair of rows while unfastening another of the pair of rows.

41. The system of claim 40 further comprising a stabilizing system for stabilizing the transforming fastener to help the slider to slide along said rows.

42. The system of claim 40 further comprising a standard zipper on each of said arm sleeves, said standard zippers allowing the user's arms to exit the jacket through openings created in the jacket when the standard zippers are unzipped.

43. The system of claim 42 further comprising flaps for holding said sleeves in towards the user's torso.

44. The system of claim 40 wherein the user may propel the slider along the rows by accessing the slider from within the jacket.

45. The system of claim 40 wherein said slider can flare apart to facilitate movement of the slider along the tracks when the user lifts his arm up away from his torso to help propel the slider along the tracks.

46. A system comprising:

a jacket wearable by a user, said jacket comprising a front side, a back side, an armpit, and a bottom end;

a transforming fastener coupled to the jacket, said transforming fastener comprising:

a plurality of tracks, each track comprising a pair of matable rows, the tracks having a first end coupled to the jacket near the armpit and a second end coupled to the bottom end of the jacket; and a slider slidably coupled to the rows, the slider dividing sleeves from said jacket, when the slider slides along said rows, by fastening one of the pair of rows while simultaneously unfastening another of the pair of rows; and a standard zipper placed on each of the sleeves to allow the user's arms to extend from the suit.

47. The system of claim 46 wherein said tracks are coupled diagonally on the front side of said jacket.

48. The system of claim 46 further comprising an anchor and a stabilizing cord coupled to said jacket for stabilizing said transforming fastener.

49. The system of claim 46 wherein said slider can flare apart to facilitate movement of the slider along the tracks when the user lifts his arm up away from his torso to help propel the slider along the tracks.

50. The system of claim 46 wherein the movement of the slider along the rows causes the rows to interchange with each other.

51. A system comprising:

a cloak wearable by a user, said cloak comprising an armpit and a bottom end;

an expansion means on said cloak for expanding the width of the cloak; and a transforming fastener coupled to the cloak, said transforming fastener comprising:

a plurality of tracks, each track comprising a pair of matable rows, the tracks having a first end coupled to the cloak near the armpit and a second end coupled to the bottom end of the cloak; and a slider slidably coupled to the rows, the slider dividing sleeves from said cloak, when the slider slides along said rows, by fastening one of the pair of rows while simultaneously unfastening another of the pair of rows.

52. The system of claim 51 further comprising:

a harness coupled to the inside of the cloak;

a carrier cloth having a first end and a second end, the first end being removably coupled to the harness; and a pair of rings inside the cloak for coupling with said second end of the carrier cloth.

53. A method comprising:

obtaining a volume of material having a bottom end, sleeves, inseams on said sleeves, and an armpit for each sleeve;

obtaining a transforming fastener, said transforming fastener comprising:

a first end and a second end;

a plurality of tracks, said tracks each comprising two matable rows; and a slider for fastening some of the rows while simultaneously unfastening other of the rows, said slider being coupled to said tracks;

coupling said transforming fastener to one of said inseams;

coupling said first end to the volume of material at a location near the armpit; and coupling said second end to the volume of material at a location near said bottom end.

54. The method of claim 53 further comprising coupling the tracks diagonally on the volume of material.

55. The method of claim 53 further comprising creating said slider as an integrally formed piece.

56. The method of claim 53 further comprising creating said slider by coupling together individual pieces.

57. A method comprising:

obtaining a volume of material having a bottom end, sleeves, and an armpit for each sleeve;

cutting a slit in said material;

obtaining a transforming fastener, said transforming fastener comprising:

a first end and a second end;

a plurality of tracks, said tracks each comprising two matable rows; and a slider for fastening some of the rows while simultaneously unfastening other of the rows, said slider being coupled to said tracks;

coupling the tracks of said transforming fastener to said slit;

coupling said first end to the volume of material at a location near the armpit; and coupling said second end to the volume of material at a location near said bottom end.

* * * * *